US005927092A

United States Patent [19]

Kushen et al.

[11] Patent Number: 5,927,092

[45] **Date of Patent: *Jul. 27, 1999**

[54] FOOD PAN REFRIGERATION UNIT

[75] Inventors: Craig Kushen, Hermosa Beach; Donald Carpenter, Huntington Beach, both of Calif.

[73] Assignee: Kairak, Inc., Harbor City, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,416

[22] Filed: Jun. 25, 1997

Related U.S. Application Data

[63] Continuation-in-part of application No. 08/527,658, Sep. 13, 1995, which is a continuation-in-part of application No. 08/383,358, Feb. 3, 1995, abandoned

[60] Provisional application No. 60/029,379, Oct. 29, 1996.

[51] Int. Cl.[6] ..... F25D 23/12; F25D 19/02; F25D 13/00

[52] U.S. Cl. ..... 62/258; 62/446; 62/448; 62/458

[58] Field of Search ..... 62/446, 258, 448, 62/449, 458

[56] References Cited

U.S. PATENT DOCUMENTS

| | | | |
|---|---|---|---|
| 2,886,395 | 5/1959 | Cahn | 62/458 |
| 4,685,311 | 8/1987 | Rastelli | 62/258 |
| 5,168,719 | 12/1992 | Branz et al. | 62/258 |
| 5,191,769 | 3/1993 | Mangini et al. | 62/258 |
| 5,355,687 | 10/1994 | Carpenter | 62/258 |
| 5,363,672 | 11/1994 | Moore et al. | 62/258 |
| 5,381,672 | 1/1995 | Haasis | 62/458 |
| 5,388,429 | 2/1995 | Shackelford et al. | 62/446 |

*Primary Examiner*—William Doerrler

*Attorney, Agent, or Firm*—Robert D. Fish; Crockett & Fish

[57] ABSTRACT

Methods and apparatus are directed to positioning proximate cooling units in novel ways in refrigerated food service and display units. Preferred embodiments include one or more of the following: (1) positioning the top of a side-pan cooling element above the top of an adjacent food pan; (2) positioning at least a portion of a side-pan cooling element above a portion of the opening of a food pan; (3) positioning multiple side-pan cooling elements between adjacent food pans; (4) movably positioning a side-pan cooling element relative to an adjacent food pan; (5) positioning a plate type side-pan cooling element as a non-linear divider among adjacent food pans, and (6) providing a pan cooler with a low capacity fan which allows cooled air to be recirculated about the food pans substantially independently of air circulation within any storage area of the refrigeration unit. In most preferred embodiments, the pan cooler has a finless sub-pan cooling element.

18 Claims, 12 Drawing Sheets

FOOD PAN REFRIGERATION UNIT

This application is a continuation-in-part of co-pending application Ser. No. 08/527,658 filed Sep. 13, 1995, which is a continuation-in-part of abandoned application Ser. No. 08/383,358 filed Feb. 3, 1995. Priority is also claimed to Provisional Ser. No. 60/029,379, filed Oct. 29, 1996.

FIELD OF THE INVENTION

The field of the invention is refrigerated food service and display units.

BACKGROUND OF THE INVENTION

It is conventional in the food service industry to serve or display food from a box-like refrigeration unit having one or more openings adapted to receive pans of food. Such units typically have a work surface which is relatively planar and horizontal, and disposed at about waist height, and a storage compartment below. In many instances the work surface has a single, elongated opening, allowing several pans to be stacked in a row, side by side, within the opening. A unitary and rectangular opening is generally employed when rectangular and box-like pans are used, and alternatively, a series of circular openings arranged side by side is generally employed when cylindrical or bowl-like pans are used. The pans are usually removable for refilling, cleaning and the like, and are generally suspended by an upper lip from the work surface so that the top of each the pan is nearly flush with the work surface. Such refrigeration units are often employed as part of a salad bar or food preparation station.

The main difficulty with refrigeration units of the type just described is the difficulty of cost-effectively maintaining the proper temperature of food contained within the various exposed pans. To some extent this difficulty is a function of the close stacking of pans, which impedes cooling of the pans. This in turn allows food within the pans to warm up, especially food near the top and central portions of the pans. Warmed food is undesirable for many reasons, including an increased danger that the warmer temperatures will lead to the growth of bacteria within the food. The situation is exacerbated by high ambient temperatures, such as may be present in a hot kitchen environment, and by the practice of leaving food in cooling pans for substantial period of time. Prep tables, for example, which are one category of refrigerated food service and display unit, are typically located next to ovens and ranges which may expose food to temperatures in excess of +75° F. The location of prep tables next to such heat sources has historically allowed food to reach undesirable temperatures such as +55° F. and above.

One of the most common methods of cooling foods contained in refrigerated food service and display units is packing the pans in ice. While useful in many instances, ice is often unsatisfactory because it is not cold enough to keep foods deep within the pans at proper temperature. It is also known to circulate cooled water or other liquid about the pans, but that solution is problematic since the pans tend to float on the circulating liquid, and the circulating liquid may tend to accumulate microorganisms and debris.

Another common method of cooling foods contained in refrigerated food service and display units is to cool the entire inside space of the storage compartment, and blow the cooled air from within the storage compartment among the pans using one or more fans. (see prior art FIGS. 1 and 2). Such storage compartment convection cooled units are relatively simple and inexpensive, but are inherently inefficient from an energy standpoint because the cooling element (also known as the evaporator or blower coil) is located relatively far from the pans, and there is an inefficient flow path for the cooled air between cooling element and pans. The inefficiency is not only costly from an operations standpoint, but is also costly from a maintenance standpoint. Thus, for example, storage cabinet based blower coils often become frozen, which in turn leads to relatively frequent service calls, replacement of the coils, and possible Freon leaks. All of these problems are exacerbated by loss of cold air around the sides of bent and/or missing pans.

In another common method of cooling exposed foods contained in refrigerated food service and display units, the food pans are set into a pan cooler which is segregated from the storage compartment below (see FIG. 3). Here, cooling coils typically wrap around the exterior surface of the inner walls of the pan cooler, and heat is radiated from the pans, through the inner walls of the pan cooler, and then carried away by the cooling coils. While practical in some circumstances, the system is still inadequate because there is not enough cooling surface surrounding the pans to transfer heat between the walls of the food pans and the inner walls of the pan receiving box. The limited heat transfer problem has been addressed by adding ice to the bottom of the pan receiving box (see FIG. 4), but here again the ice is generally not cold enough to adequately cool the food in the food pans.

In still another method, described in our U.S. Pat. No. 5,355,687 (the '687 patent), cooling plates are positioned between adjacent pans. Although the apparatus taught by the '687 patent is quite efficient and cost effective, it may be viewed as being insufficiently adaptable to a sufficiently broad range of pan configurations. A refrigeration unit according to the '687 patent, for example, may have difficulty cooling particularly deep or wide pans, and may not satisfactorily handle unusual arrangements of pans.

Thus, there remains a need to provide refrigerated food service and display units which are efficient, cost effective, and readily adaptable to site specific circumstances.

SUMMARY OF THE INVENTION

The present invention provides novel methods and apparatus directed to positioning of cooling elements proximate to the food pans of refrigerated food service and display units. In preferred embodiments the improvements include one or more of the following: (1) positioning the top of a side-pan cooling unit above the top of an adjacent food pan; (2) positioning at least a portion of a side pan cooling element above a portion of the opening of a food pan; (3) positioning multiple side-pan cooling units between adjacent food pans; (4) movably positioning a side-pan cooling unit relative to an adjacent food pan; (5) positioning a side-pan cooling unit as a nonlinear divider among adjacent food pans; and (6) providing a sub-pan cooling unit which preferably cools the pans via a channeled air flow path.

Various objects, features, aspects and advantages of the present invention will become more apparent from the following detailed description of preferred embodiments of the invention, along with the accompanying drawings in which like numerals represent like components.

DETAILED DESCRIPTION OF THE DRAWING

Figure 1:
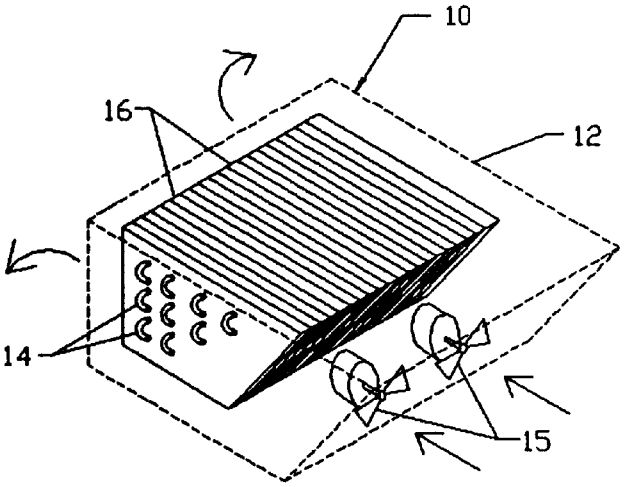
FIGURE 1 (PRIOR ART)
FIG. 1 is a perspective view of a conventional storage compartment evaporator.

FIG. 1 generally depicts a conventional prior art evaporator 10 mounted inside the storage compartment of the refrigeration unit (not shown). The evaporator 10 has an aluminum housing 12 encasing coils or tube structure 14 which loops back and forth through an array of thin (0.014 inch thick) aluminum fins 16. The fins 16 are generally parallel to each other and contact the tubes 14 at right angles. A refrigerant such as Freon flows through tubes and motors mounted in the housing 12. Fans 15 pull air through the housing 12 and force it between the fins to cause the liquid refrigerant to change states and become gaseous. This results in the removal of heat from the air flowing past the fins, thereby reducing the temperature of the air.

Figure 2:
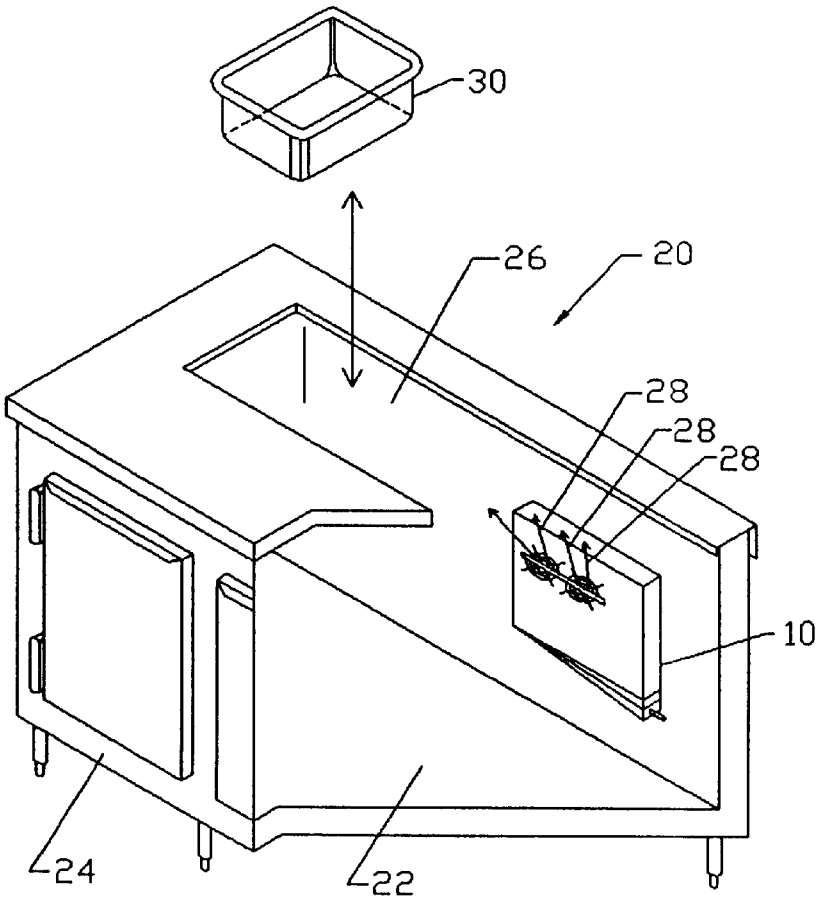
FIGURE 2 (PRIOR ART)
FIG. 2 is a perspective cut-away of a refrigeration unit containing the evaporator of FIG. 1.

FIG. 2 generally depicts a prior art refrigeration unit 20 having a storage section 22 with an access door 24, a pan receiving area 26, and a conventional evaporator 10 such as that depicted in FIG. 1. Air cooled by the evaporator 10 is generally blown upwards against the bottoms of the food pans 30 in the direction of arrows 28 by high capacity fans, generally operating at above 3000 rpm and moving about 180 cubic feet of air per minute.

In refrigeration units such as that depicted in FIG. 2, the extent to which food in inset pans can be cooled is largely limited by the lower temperature limits of the evaporator. For example, when the fixture temperature is set below +34° F. the aluminum fins tend to freeze and create unwanted freezing of food in the storage compartment. The freezing restricts air flow through the fins, and greatly reduces efficiency. Defrost heaters can solve the freezing problem to some extent, but at a considerable added cost. Thus, a typical eight foot refrigeration unit may conventionally require three evaporators and high sped fans in an effort to cool insert pans, and the total energy consumption may reach 4.5 Amps or more. Even then, when cold air can be reliably blown upwards from within the storage compartment, the food in the bottoms of the pans tends to freeze before the food in the tops of the pans becomes sufficiently cold.

Figure 3:
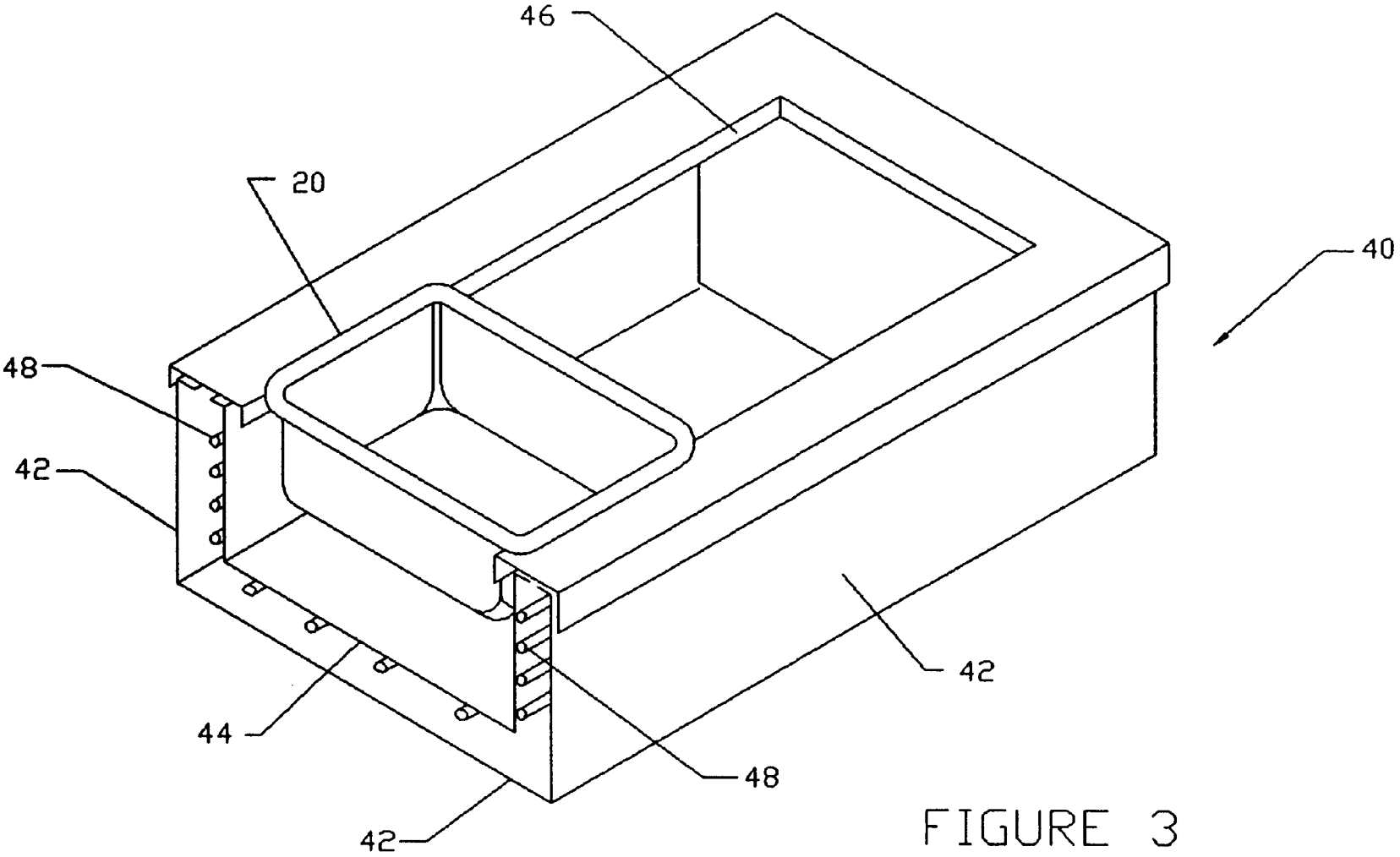
FIGURE 3 (PRIOR ART)
FIG. 3 is a perspective, partial cut-away of a conventional pan receiving box.
Figure 4:
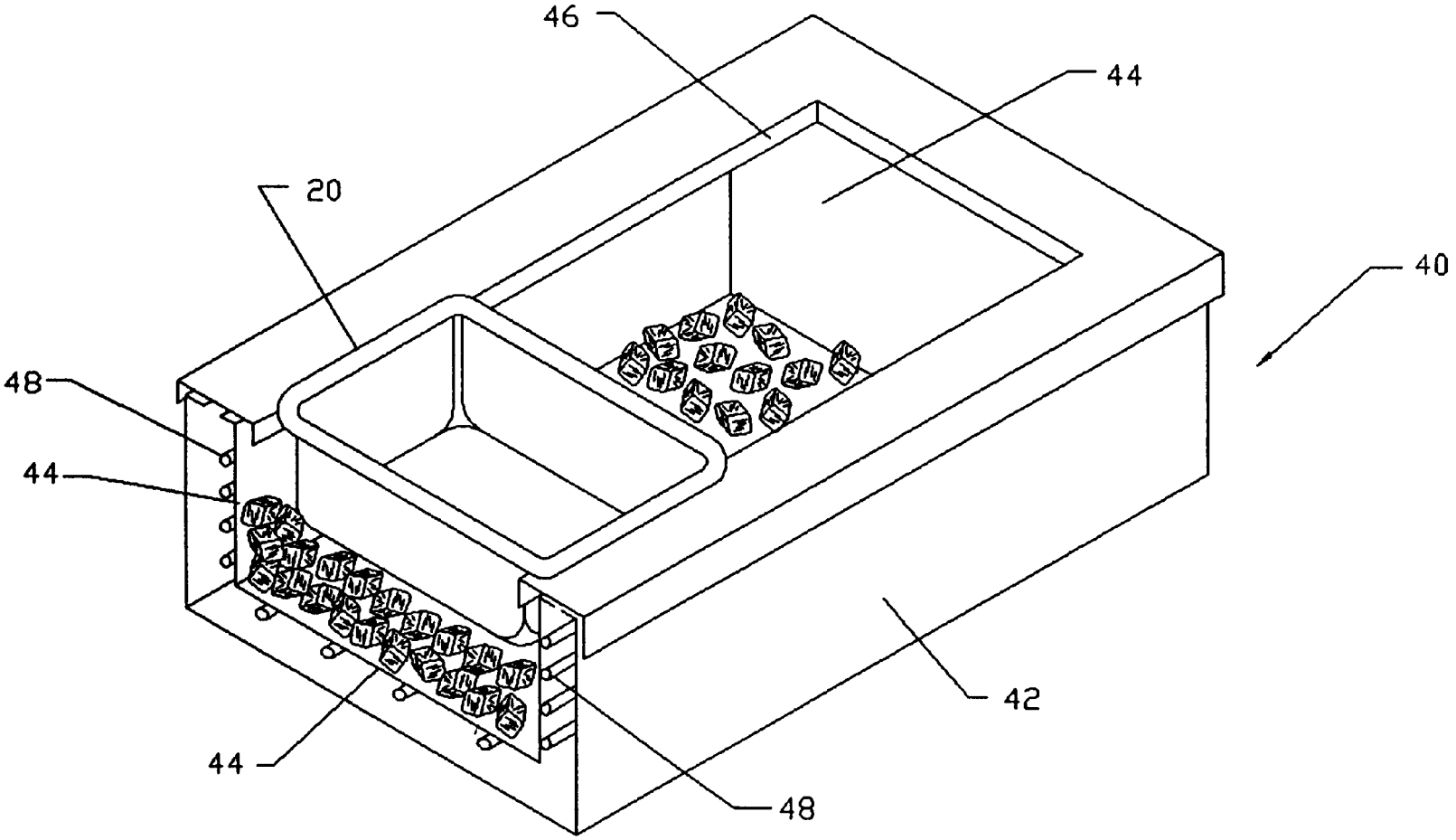
FIGURE 4 (PRIOR ART)
FIG. 4 is a perspective, partial cut-away of a conventional pan receiving box containing ice.

FIGS. 3 and 4 depict previous attempts to bring the cooling elements closer to the pans. In FIG. 3 a typical prior art pan cooler 40 generally has outer walls 42, inner walls 44, and an edge 46 which supports pan(s) 20. Cooling coils 48 are disposed along the side and bottom inner walls 44, between the inner walls 44 and the outer walls 42. In FIG. 4 ordinary water ice is placed between the pan 20 and the inner walls 44 of the pan receiving box 40 to assist in transferring heat from the pan(s) 20 to the cooling coils 48. Embodiments according to FIGS. 3 and 4 have consistently proven to be less than completely satisfactory for cooling exposed food. In large part this is because the pans do not have enough cooling surface to compensate for the relatively warm temperature (32°) of water ice.

Figure 5:
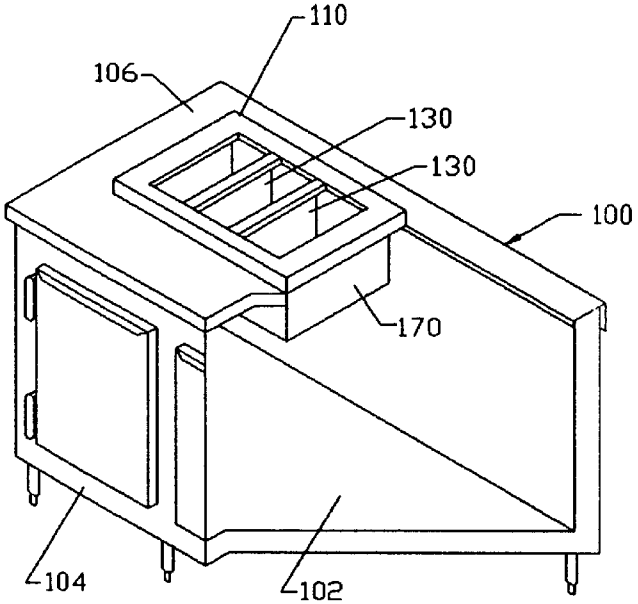
FIG. 5 is a perspective cut-away of a refrigeration unit having an at least partially segregated sub-pan cooler according to one aspect of the invention.
Figure 6:
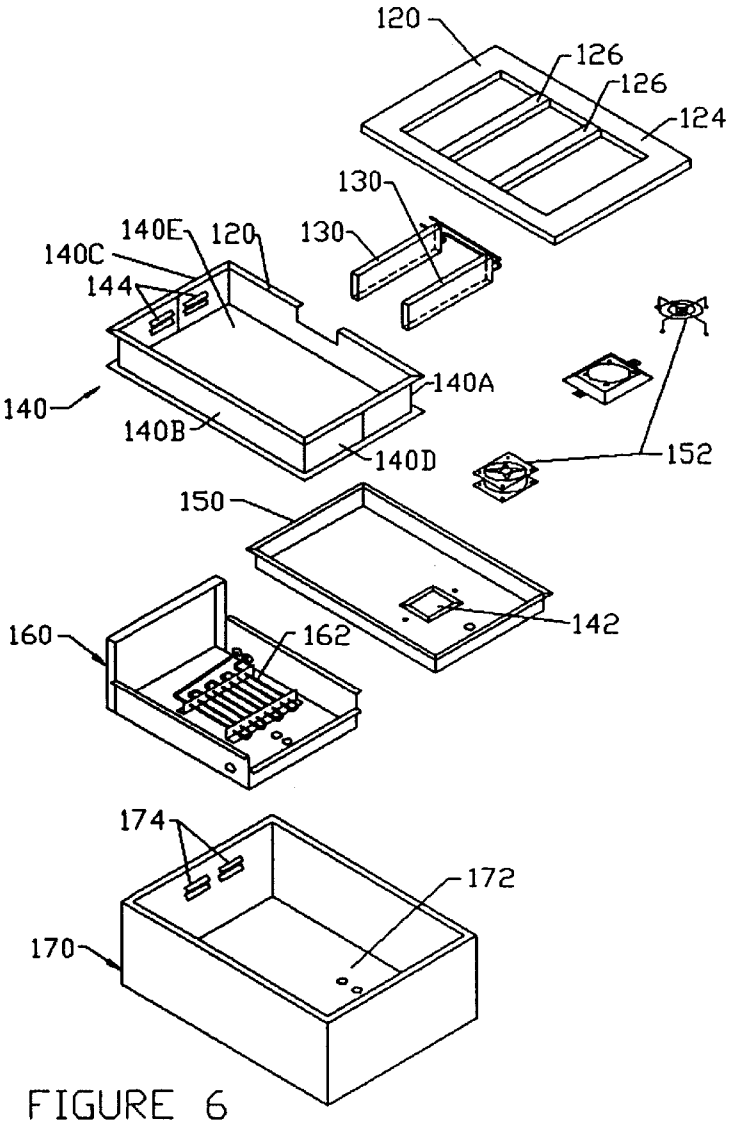
FIG. 6 is an exploded perspective view of the pan cooler of FIG. 5.

FIGS. 5 and 6 depict a refrigeration unit 100 which is far more effective than any of the prior art devices in reliably cooling food held within food pans. Here, the effectiveness is largely produced by having a substantially segregated pan cooler 110 in which air cooled by a plurality of proximal cooling units is blown across the food pans at relatively slow speed, operating at between about 1000 and about 1500 rpm, and moving less than about 90 cubic feet of air per minute.

Focusing first on FIG. 5, the refrigeration unit 100 has a cabinet with a storage section 102 and an access door 104, a counter 106, and an opening for receiving a pan cooler 110. The pan cooler 110 may be permanently affixed to the cabinet, although more likely the pan cooler 110 will be operator removable from the cabinet, or will sit on top of the cabinet. Turning now to the exploded view of FIG. 6, the pan cooler 110 generally includes a top portion 120, side-pan cooling plates 130, an inner housing 140, an bottom tray 150 with fan assembly 152, a sub-pan cooling unit 160, and an outer housing 170. Most of these components are advantageously manufactured from stainless steel to avoid rust and to enhance ease of cleaning. Other materials, however, can be used as well, including various plastics and composites.

The top portion 120 advantageously includes a rim 124 and pan mounting bars 126, which together form a grid having spaces for receiving food pans. The pan spaces thus formed are substantially rectangular with parallel sides, but other configurations are contemplated as well. For example, pan spaces may be circular, oblong, star shaped, or have any other desired configuration and orientation relative to one another. The pan spaces in FIGS. 5 and 6 are also depicted as defining fixed pan positions, as positioning the pans substantially flush with the top of counter 106, and as positioning the sides of the pans substantially adjacent the proximal cooling elements 130. These specific depictions, however, should not be interpreted as limitations, and it is contemplated that the pan positions may be variable, raised or lowered relative to the counter, and that the sides of the pans need not be substantially adjacent the cooling elements.

Pans (not shown) used in conjunction with the refrigeration unit 100 are generally open on top so that users may remove food from the pans while the pans are seated in the opening of a cabinet. Typically, the pans have a volumetric capacity ranging between about 50 and about 800 cubic inches, with a depth ranging from about 2 to about 8 inches, a width from about 3 to about 12 inches, and a length from about 6 to about 20 inches. The pans are preferably made of metal, usually stainless steel, and are known in various configurations including rectangular and box-like, cylindrical, bowl-like, etc. They are conveniently handled by one person and are dropped into the opening. The pans typically have an outwardly extending ledge that engages the edge of the opening and/or bars or other support structure.

The side-pan cooling units 130 are advantageously constructed as plates according to the teachings of the '687 patent, although they may alternatively be constructed according to other teachings. Exemplary plates were described in detail in the '687 patent, which is incorporated herein in its entirety. In general, such plates are contemplated to be generally flat, rectangular enclosures, preferably having dimensions between about 3" and 12" high, between about 6" and 48" long, and between about $\frac{1}{8}^{th}$ and 1" wide. The side-pan cooling plates 130 are preferably disposed between adjacent pans, parallel to the adjacent side walls of the respective pans to provide even cooling of the pans. It is contemplated that the average distance between the side walls of the pans and the cooling elements can vary widely between about ⅛ and about 2". It is, however, preferred that the average distance is between about ¼ and about ½. The side-pan cooling units 130 are preferably constructed from stainless steel, but may alternatively be constructed of other materials. As described in the '687 patent, a refrigerant will usually communicate with a distal compressor and condenser (not shown) via refrigerant conduits (not shown), and the refrigerant may be disposed directly within passages of the plates, or within a circuitous length of copper or other tubing (not shown) disposed on or within the plates. The various portions of the tubing and conduits may be soldiered (sweated) together to facilitate construction and repair.

The inner housing 140 is basically a bottomless hollow box having four sides 140A, 140B, 140C and 140D, which mates with the top portion 120 and the bottom tray 150 to define a pan cooling chamber (also referred to herein as a pan cooling area). The sides 140A, 140B, 140C and 140D may optionally have a plurality of side openings 144. Thus, in conjunction with other components the inner housing 140 provides an at least partially enclosed space through which cold air from the side-pan and sub-pan cooling elements is channeled past the food pans, and comes in contract with plates 130 to create an efficient cooling chamber.

The bottom tray 150 has a small opening 142 to receive a fan assembly 152 or other air circulation apparatus. In FIG. 6 the fan assembly 152 is positioned between the inner housing 140 and the bottom tray 150 so that air is recirculated around both the side pan cooling plates 130 and the sub-pan cooling unit 160. Of course, the fan assembly 152 is operated by a motor (not shown) of some sort such as a low amperage motor of less than 0.25 amps, which in turn is advantageously powered by electricity through a power cord (not shown). Ideally, the fan assembly 152 will be located no more than about 5" below the bottom of the lowest food pan, and this features distinguishes the prior art of FIG. 1 where the fan is generally much farther than 5" below the bottom of the lowest food pan. By positioning the fan assembly 152 relatively close to the bottom of the food pans, and working in conjunction with cooling plates 130, a low amperage motor is sufficient to effect necessary cooling, and the power consumption is reduced.

It is contemplated, for example, that the power requirements for the motor can be is less than about 60 watts. This combination also allows embodiments as claimed herein to maintain exposed food in insert pans to stay at proper temperatures in even relatively hot kitchens and other environments.

The sub-pan cooling unit 160 contains a cooling element 162, which again may be constructed of circuitous copper or other tubing, and may again be connected to a distal compressor and condenser (not shown) via refrigerant conduits (not shown). It is contemplated that the sub-an cooling unit 160 and the air flow can be arranged with respect to the fan assembly 152 to provide a countercurrent cooling of the circulating air.

While the cooling elements 162 utilized within the sub-pan cooling unit 160 may be constructed to about the same dimensions and according to the same principles as those used for the side-pan cooling units 130, other sizes and constructions may be employed instead. Moreover, the number, size, configuration and location of the cooling elements 162 need not be that depicted in the drawings. One of the chief advantages of embodiments according to this aspect of the invention is that the cooling elements 162 may comprise copper or other tubing without any evaporator fins. The absence of cooling fins largely eliminates the bridging/freezing problems discussed above with respect to FIGS. 1 and 2, and therefore facilitates the efficient flow of air over the cooling elements—which in turn enables the unit to run at colder temperatures.

The outer housing 170 is basically a simple box, preferably constructed of stainless steel, which defines a cavity 172. The outer housing 170 may, however, advantageously employ an insulating liner (not shown) to help maintain a temperature difference between the cavity 172 and the cabinet storage section 102. The insulated liner will also assist in keeping the sides of the outer housing 170 from condensating.

Figure 7:
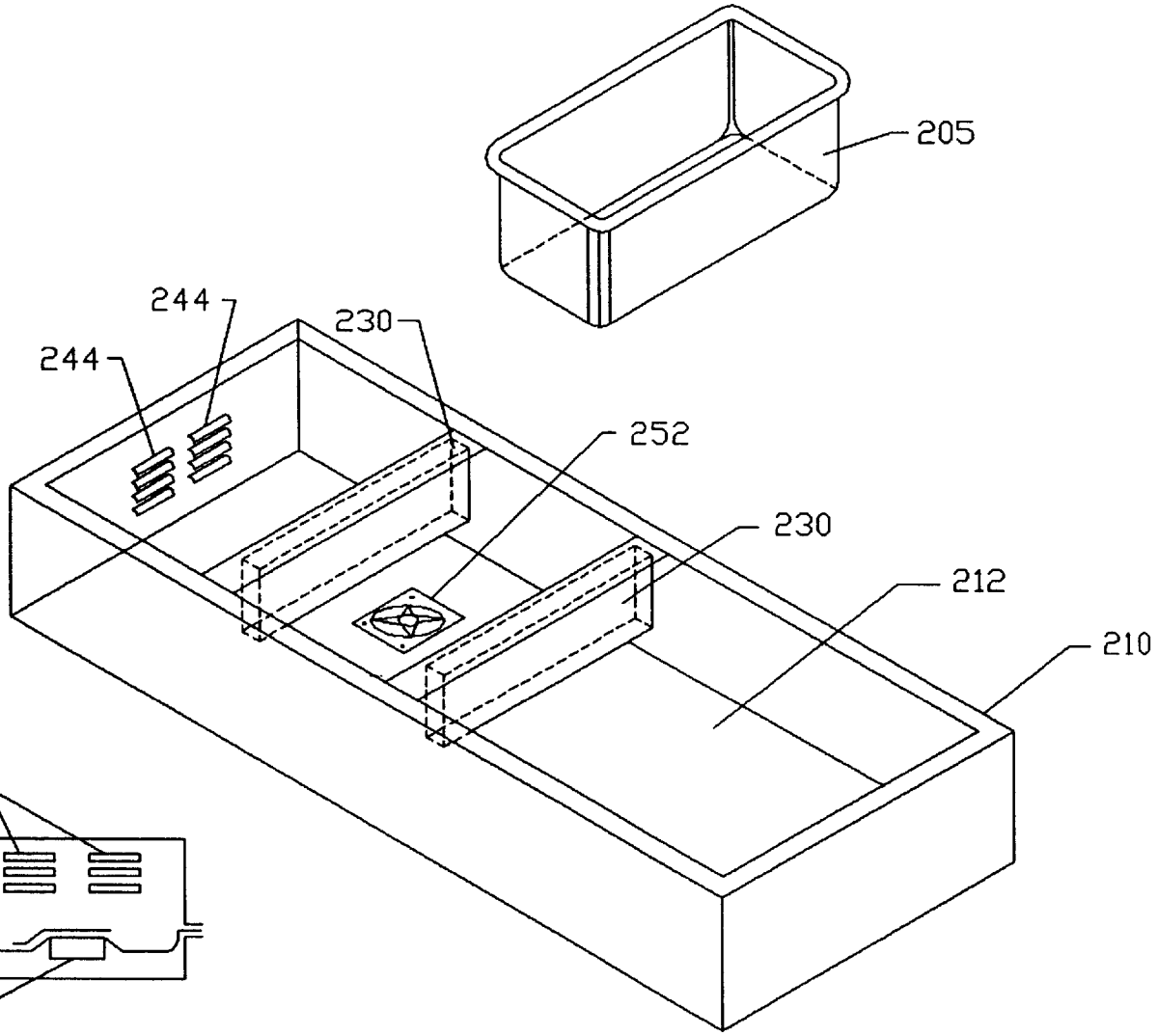
FIG. 7 is a perspective schematic of a pan cooler having an at least partially segregated pan cooler according to another aspect of the invention.
Figure 8:
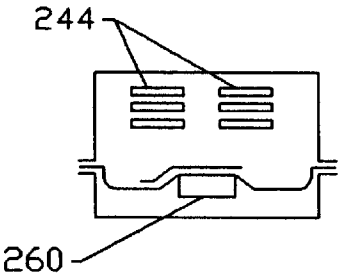
FIG. 8 is an end-view of the pan cooler of FIG. 7.
Figure 9:
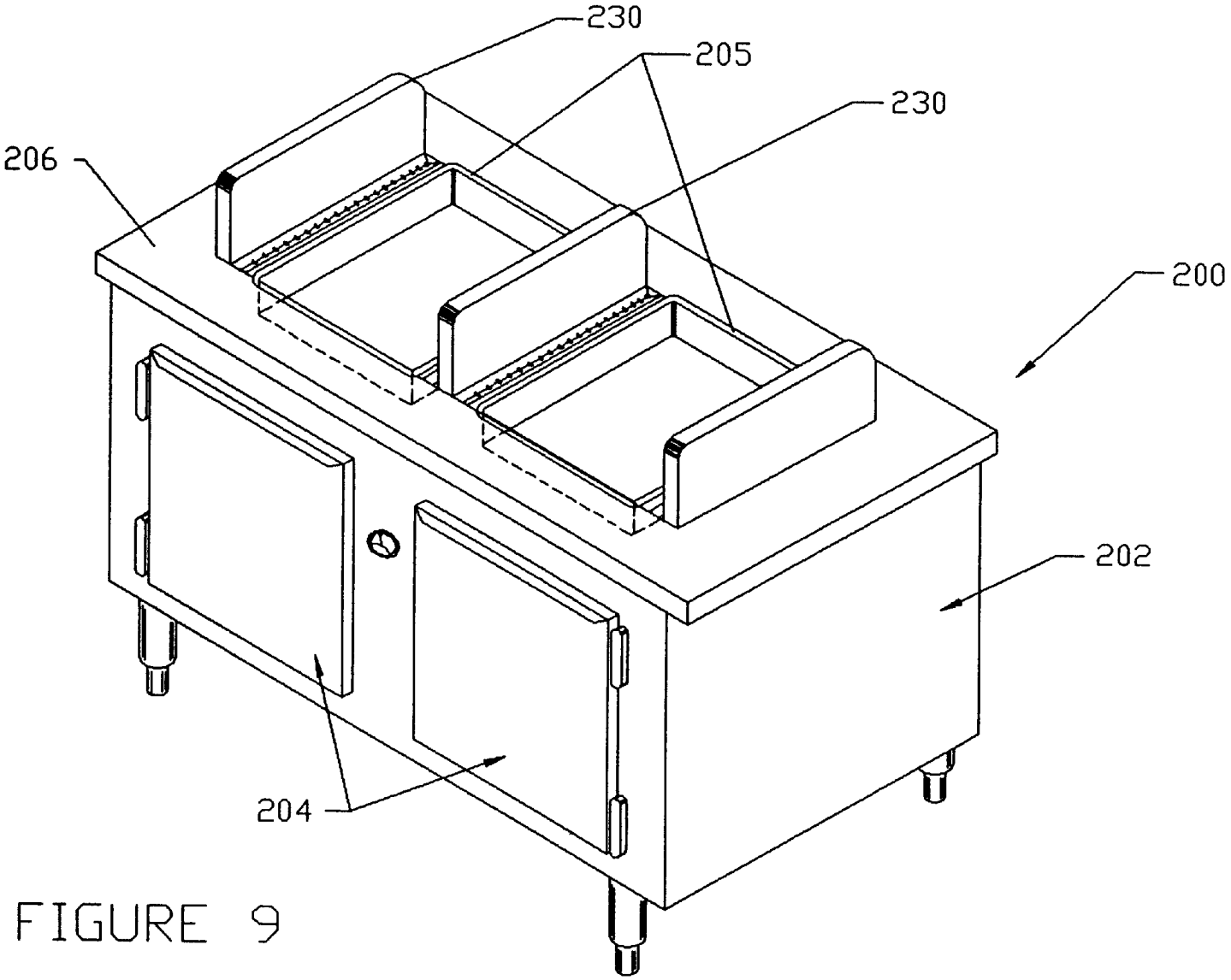
FIG. 9 is a perspective cut-away of a refrigeration unit including elevated side-pan cooling plates.

FIGS. 7, 8 and 9 depict another aspect of the inventive subject matter in which a pan cooler 210 has a plurality of side-pan cooling units 230 which are elevated relative to the adjacent food pans 205 and the counter top 206. A significant advantage of this embodiment is that the elevated side-pan cooling units 230 provide a blanket of cooled air over the top of the pans 205, thus helping to cool the top surface of any food in the pans 205. It is contemplated that the side-pan cooling units 230 need to be raised no more than about 1 above the counter top 206 to be effective, although greater and lesser distances may be satisfactory in specific circumstances. The side-pan cooling units 230 need not be fixed in the positions shown, and it is contemplated that they can be raised and lowered using a compound pivot (not shown) or a window type slider (not shown) using flexible compression hose to carry the refrigerant.

Other aspects of this embodiment may be similar to embodiments discussed elsewhere herein. For example, the corresponding refrigeration unit 200 may contain a cabinet having a storage compartment with access doors 204. Also, the size and construction of the side-pan cooling units 230 may be similar to the side-pan cooling units 130 of FIG. 6. Similarly, the pan cooler 210 may include a sub-pan cooling unit 260 (not shown) having a fan 252 similar to that described with respect to FIG. 6. The same caveat will also hold true for embodiments discussed with respect to the remaining Figures, namely that in each case it is contemplated that construction of the cooling elements and other aspects of embodiments may include teachings related to embodiments discussed elsewhere herein.

Figure 10:
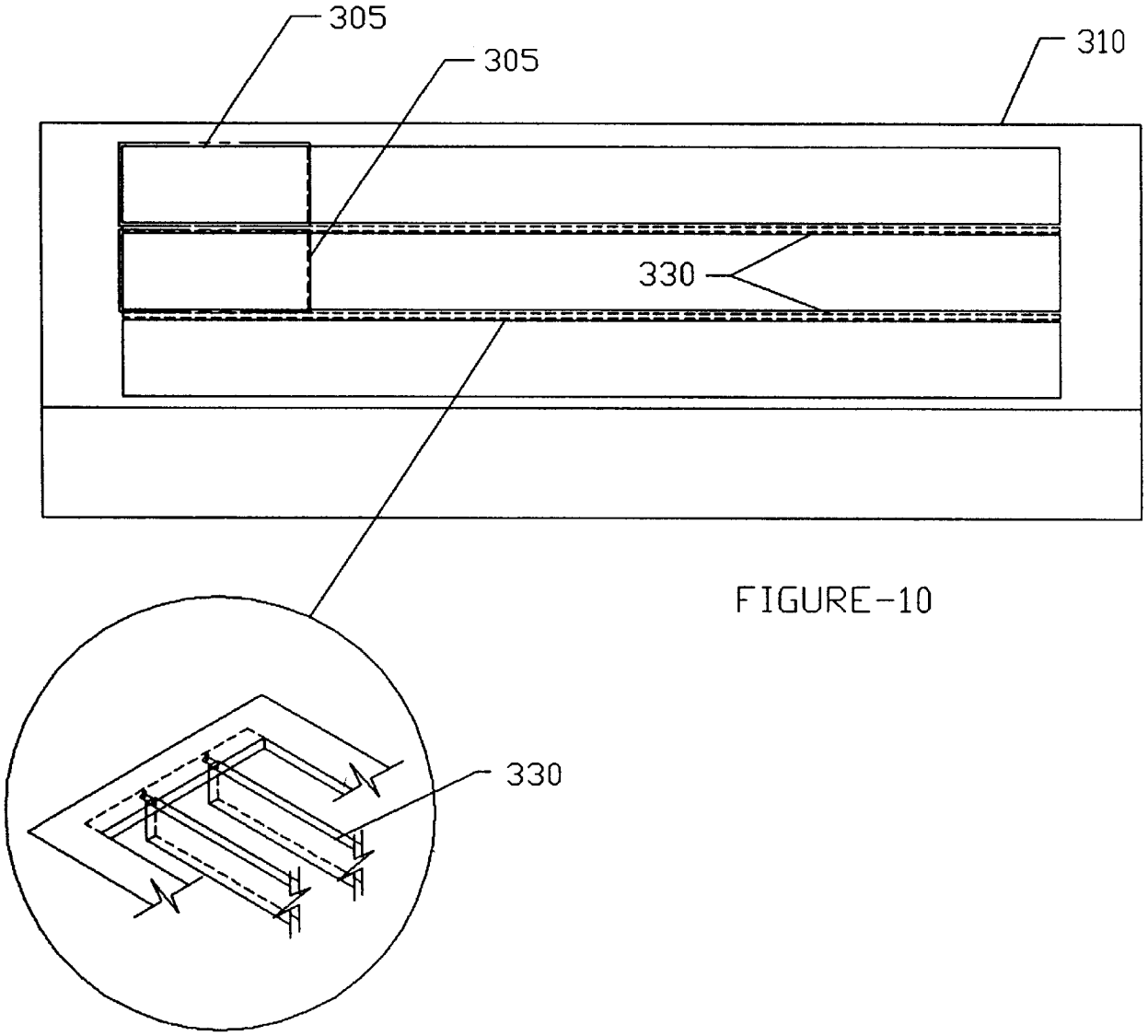
FIG. 10 is a plan view schematic of an elongated pan cooler having longitudinally disposed cooling elements.

FIG. 10 depicts an alternative refrigeration unit in which horizontal cooling plates 330 run the length of the pan cooler 310, and along at least portions of the sides of at least some of the food pans 305. Of course, other variations are contemplated here as well, including embodiments (not shown) in which horizontal cooling plates or other elements run across the bottoms of a row of food pans, spaced from the food pans by about ¼". In other contemplated embodiments horizontal cooling elements may be positioned about 2" above the food pans, and be slanted inwards towards the openings of the food pans.

The same concept can be applied in other ways as well, as for example, by providing a ringed cooling element (not shown) projecting slightly inward from above the top circumference of a bowl shaped pan (not shown), and hinging the cooling element at the counter top the so that the pan can be removed. Here again, a significant advantage is that horizontal cooling plates or other elements could provide a blanket of cooled air beneath, or over the top of the pans.

Figure 11:
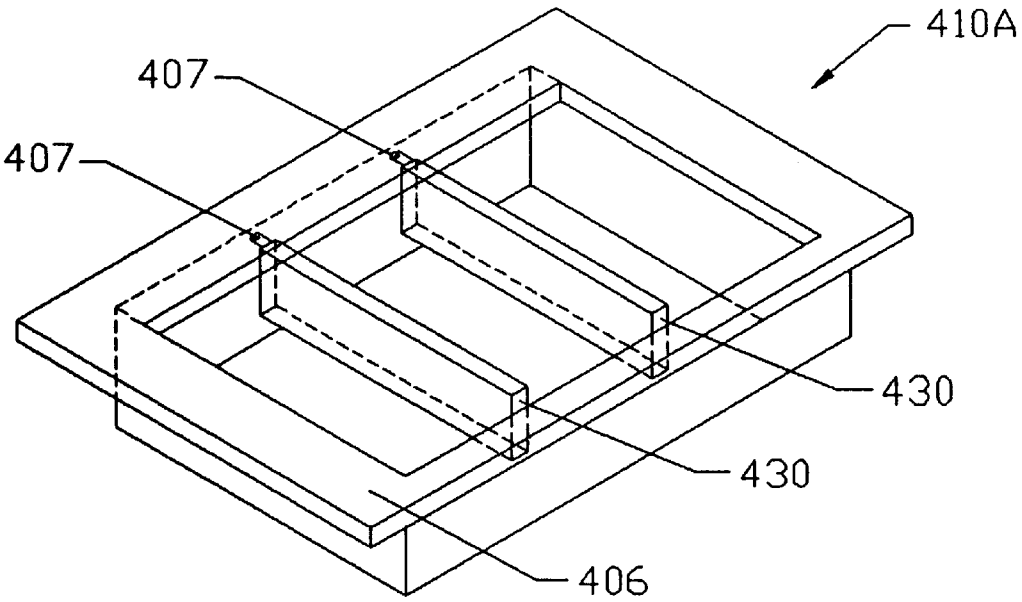
FIGS. 11–16 are perspective schematics of alternative pan coolers according to other aspects of the invention.
Figure 12:
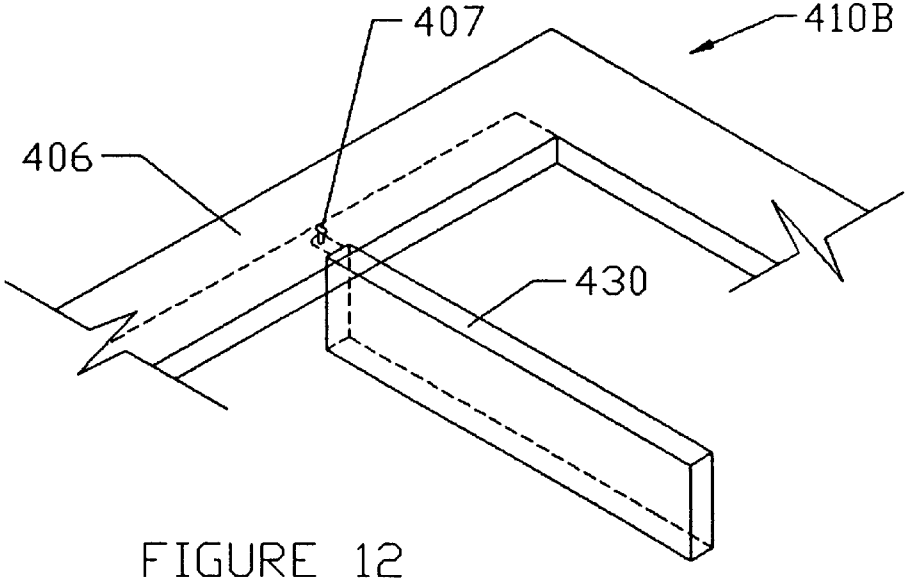

FIGS. 11 and 12 depict additional pan coolers 410A, 410B according to yet another aspect of the invention, in which movable cooling elements 430 adapt to different size pans. In a preferred embodiment the movable cooling elements 430 are pivoted at one end relative to the counter top 406 using pivots 407. In other embodiments, (not shown) the movable cooling element may be secured to the counter top by a slider, using a flexible compression hose to carry the refrigerant. In all such embodiments it is preferred that the position of the movable cooling element can be adjusted by hand, although some tools may be needed.

Figure 13:
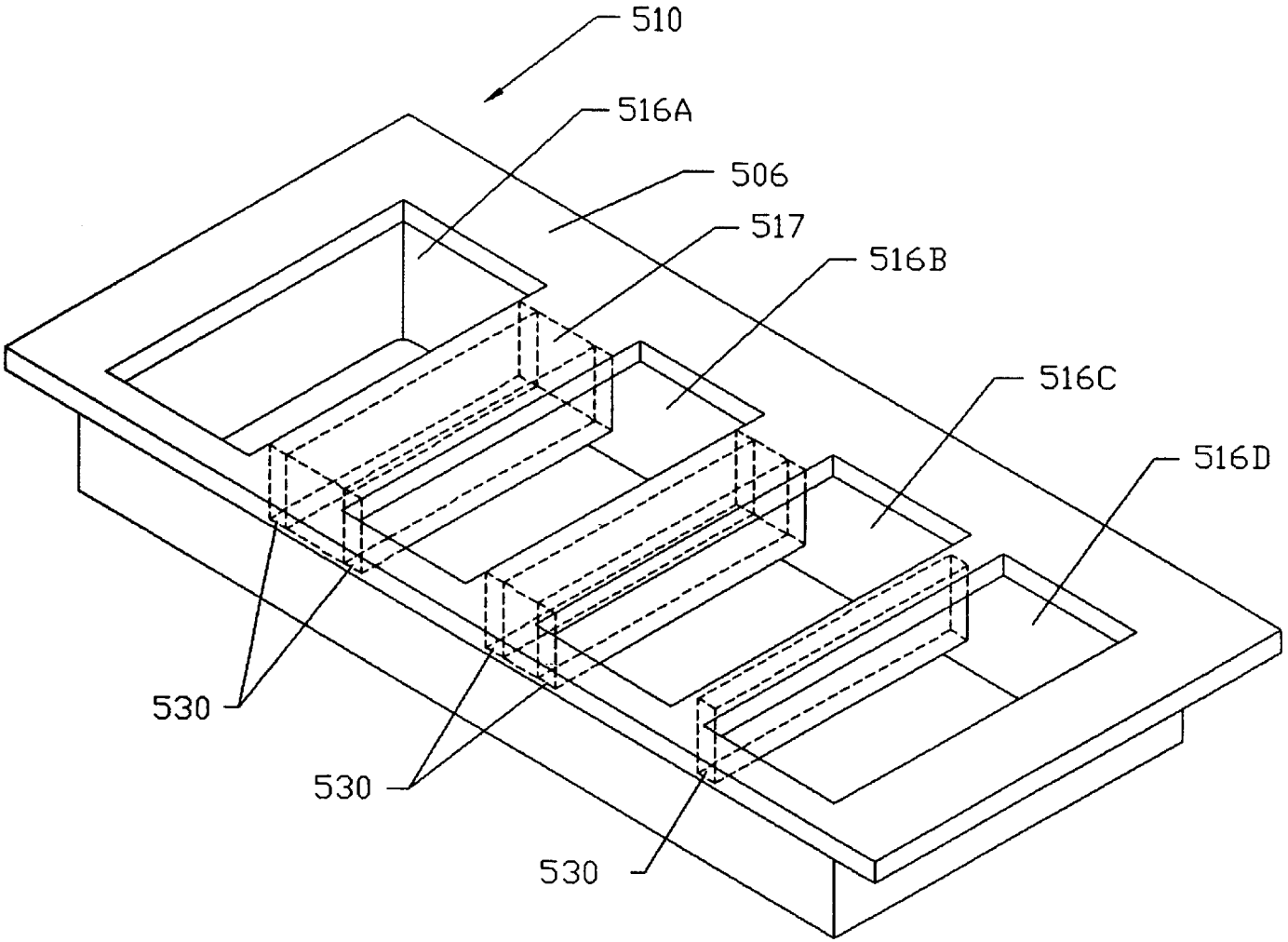

FIG. 13 depicts yet another pan cooler 510, in which more than one side-pan cooling units 530 are present between some of the adjacent food pans (not shown). For example, in a preferred embodiment, the counter top 506 defines at least some pan positions 516A, 516B separated by two cooling elements between which is sandwiched a layer of insulation 517. In other embodiments there may be more or less space between the cooling elements, and there may or may not be a layer of insulation between the cooling elements. Of course, some of the pan positions such as 516C and 516D may be separated by only a single cooling element 530.

Figure 14B:
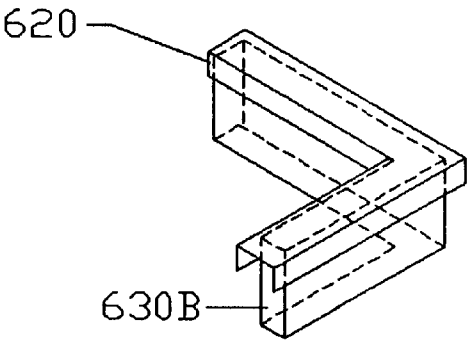
Figure 14C:
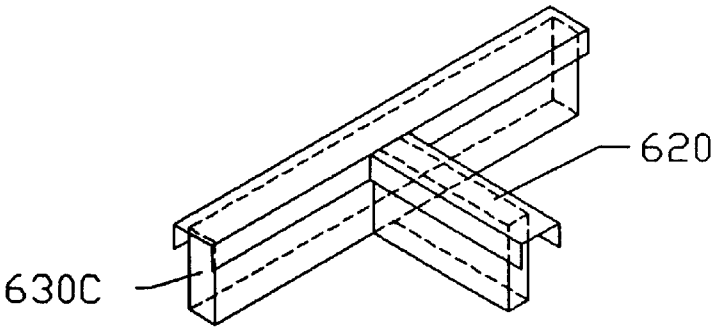
Figure 14A:
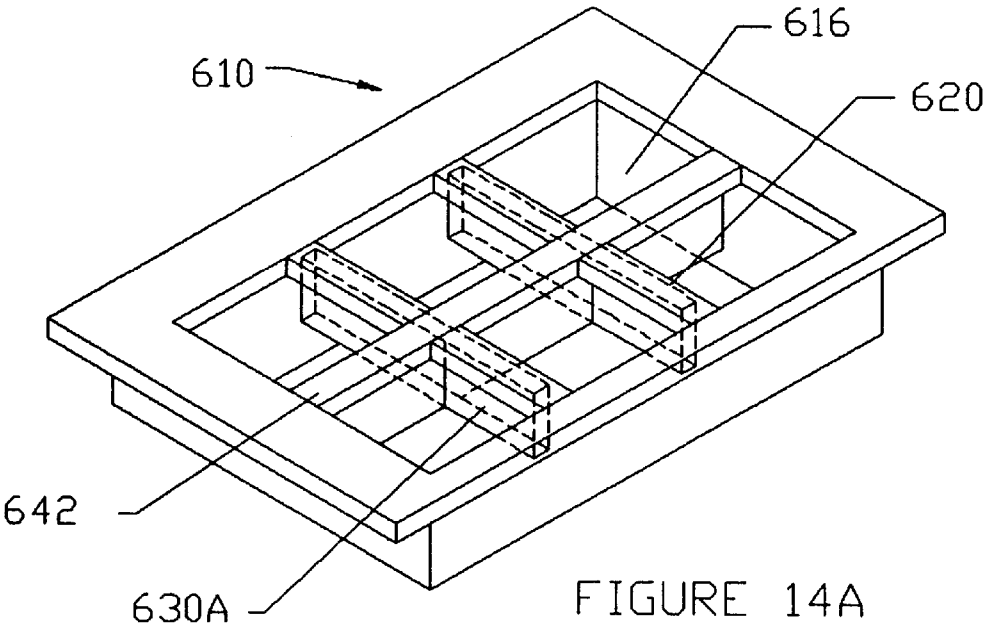

FIGS. 14A–14C depict aspects of yet another alternative pan cooler 610, in which the side-pan cooling units 630A–630C are nonlinear. In FIG. 14A the continuity of the side-pan cooling units 630B are "L-shaped," and in FIG. 14C the side-pan cooling units 630C are"T-shaped." In other embodiments (not shown) the side-pan cooling units may be curved, or may include combinations of non-linear shapes. As further shown in FIGS. 14A–14C, a "U" shaped support bar 620 may be used to protect the tops of the proximal cooling elements.

Figure 15A:
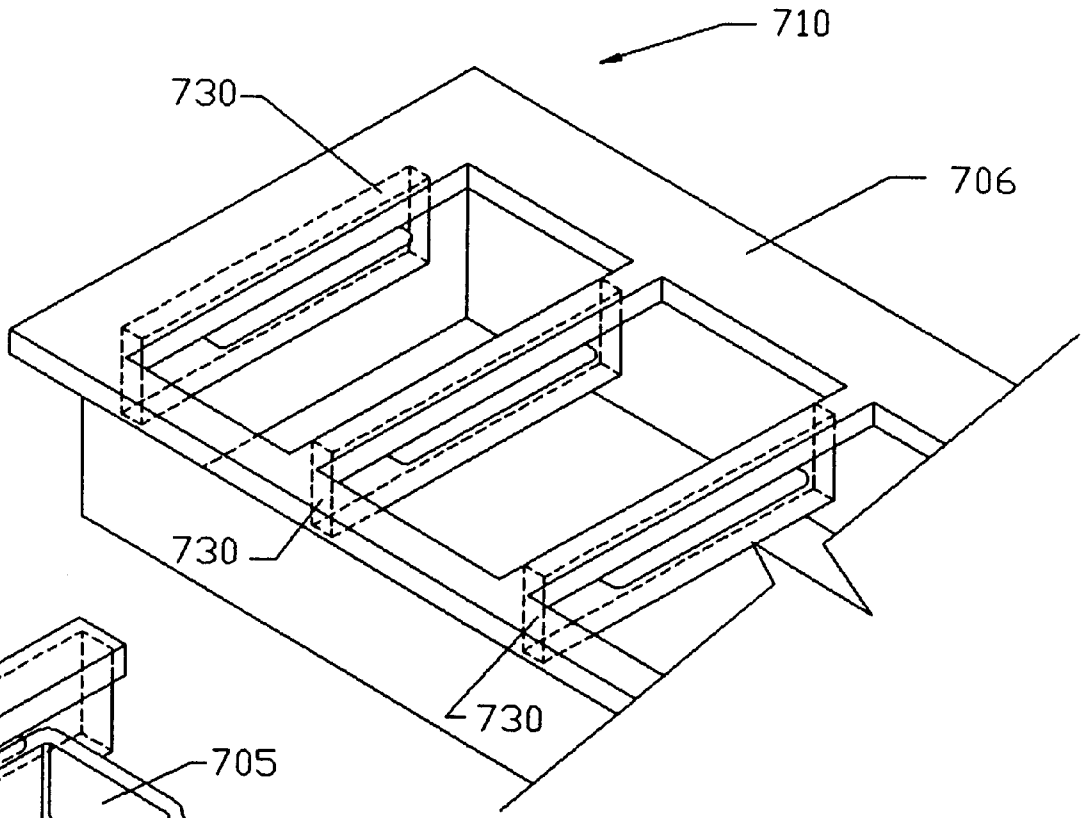
Figure 15B:
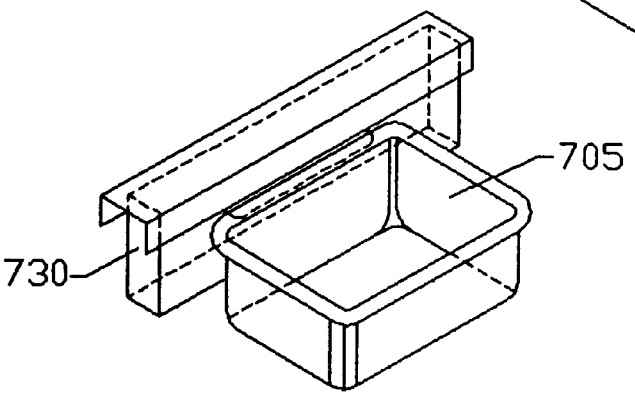

FIGS. 15A and 15B depict yet another alternative pan cooler 710, in which the top of one or more food pans 705 is vertically recessed below the top of an adjacent side-pan cooling unit 730. This embodiment is somewhat similar to embodiments described with respect to FIGS. 7–9 in that it encourages a blanket of cooled air to float at the top surface of the food in the food pan 705. A major difference, however, is that in FIGS. 7–9 the tops of the food pans 205 are still essentially flush with the top of the counter top 206, whereas here the top of the food pans 705 are recessed below the top of the counter top 706.

Figure 16:
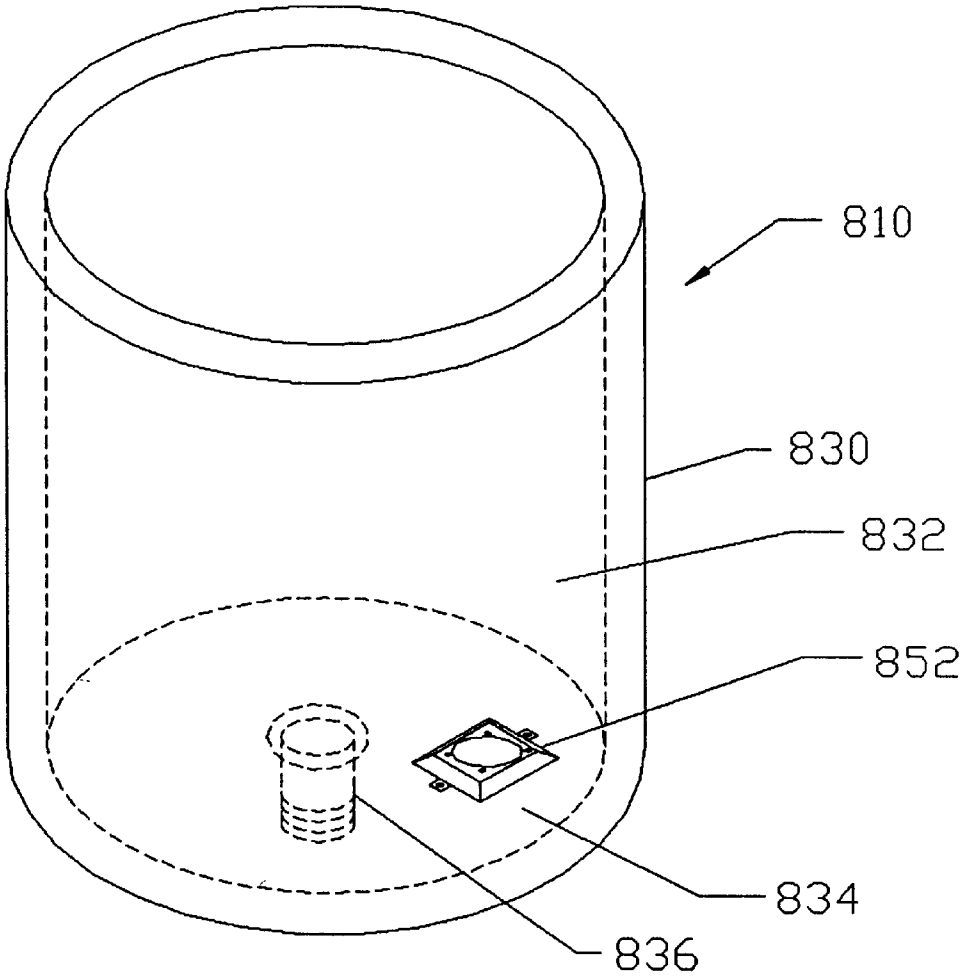

FIG. 16 depicts yet another alternative pan cooler 810, in which a round or rounded side-pan cooling unit 830 provides a cooling chamber 832 sized and dimensioned for use with round or rounded food pans such as bowls (not shown). In a preferred embodiment a small fan assembly 852 may be positioned along the bottom wall 834 of the pan cooler 810 to circulate air from a sub-pan cooling unit (not shown). A drain 836 may also be provided in the bottom wall 834.

Thus, many improvements to food cooling and storage systems have been set forth. While specific embodiments and applications have been shown and described, it would be apparent to those skilled in the art that many more modifications are possible without departing from the inventive concepts herein. The invention, therefore, is not to be restricted except in the spirit of the appended claims.

What is claimed is:

1. A method of refrigerating food in a food pan comprising:

providing a housing having a work space with at least one opening;

placing the food pan in the opening;

providing a cooling element proximate the first food pan; and movably positioning the cooling element relative to the food pan.

2. The method of claim 1 further comprising pivoting the cooling element about a pivot.

3. A refrigeration unit comprising:

a cabinet defining a storage compartment;

a pan cooler removably inserted in the storage compartment defining a pan cooling compartment for receiving a food pan, and a cooling element compartment having at least one cooling element;

a passageway between the pan cooling compartment and the cooling element compartment, through which air is circulated between the outside of the food pan and the at least one cooling element; and where the storage compartment, pan cooling compartment, and cooling element compartment are all physically distinct from one another.

4. The refrigeration unit of claim 3 wherein a fan moving less than about 90 cubic feet of air per minute is used to move the air circulating between the food pan and the at least one cooling element.

5. The refrigeration unit of claim 3 wherein the pan cooler is operator removable from the cabinet.

6. The refrigeration unit of claim 3 wherein the sub-pan cooling element does not have evaporator fins.

7. The refrigeration unit of claim 3 further comprising a side-pan cooling element.

8. The refrigeration unit of claim 4 wherein the pan cooler is operator removable from the cabinet.

9. The refrigeration unit of claim 7 further comprising at least two food pans, wherein the side-pan cooling element has a position which can be adjusted by hand.

10. The refrigeration unit of claim 7 wherein the food pan is vertically recessed relative to the side-pan cooling element.

11. The refrigeration unit of claim 3 further comprising a counter top, wherein the food pan is substantially flush mounted relative to the counter top.

12. The refrigeration unit of claim 4 wherein the fan is physically disposed between the at least one cooling element and the food pan.

13. A refrigeration unit comprising:

a cabinet defining a storage compartment air space;

a pan cooling compartment disposed in the cabinet and defining a pan cooling air space substantially distinct from the storage compartment air space, and the pan cooling compartment further including a cooling element, a space for receiving a food pan, and a fan circulating air between the cooling element and the outside of the food pan, such that the temperature of the pan cooling air space can be controlled substantially independently of the temperature of the storage compartment air space.

14. The refrigeration unit of claim 13 wherein the fan moves less than about 90 cubic feet of air per minute.

15. The refrigeration unit of claim 13 wherein the cooling element does not have evaporator fins.

16. The refrigeration unit of claim 13 wherein the pan cooling compartment further includes a side-pan cooling element.

17. The refrigeration unit of claim 13 wherein the fan moves less than about 90 cubic feet of air per minute, and the cooling element does not have evaporator fins.

18. The refrigeration unit of claim 17 wherein the pan cooling compartment further includes a side-pan cooling element.

* * * * *